US008500514B2

(12) United States Patent
Osaka

(10) Patent No.: US 8,500,514 B2
(45) Date of Patent: Aug. 6, 2013

(54) APPARATUS AND METHOD FOR PROCESSING PISTON

(75) Inventor: Shuji Osaka, Iruma (JP)

(73) Assignee: Koganei Seiki Co., Ltd., Iruma-shi (JP)

( * ) Notice: Subject to any disclaimer, the term of this patent is extended or adjusted under 35 U.S.C. 154(b) by 422 days.

(21) Appl. No.: 12/962,881

(22) Filed: Dec. 8, 2010

(65) Prior Publication Data

US 2012/0149282 A1 Jun. 14, 2012

(51) Int. Cl.
*B24B 1/00* (2006.01)

(52) U.S. Cl.
USPC ..... 451/10; 451/5; 451/11; 451/49; 451/58; 451/65; 451/123; 451/461

(58) Field of Classification Search
USPC ..... 451/5, 10, 11, 49, 58, 65, 123, 242, 451/461, 178; 700/190, 164
See application file for complete search history.

(56) References Cited

U.S. PATENT DOCUMENTS

| | | | | |
|---|---|---|---|---|
| 2,496,352 | A * | 2/1950 | Metzger et al. | 451/548 |
| 3,717,934 | A | 2/1973 | Ishikawa | |
| 4,102,082 | A * | 7/1978 | Katsumi et al. | 451/239 |
| 4,637,169 | A * | 1/1987 | Sigg | 451/11 |
| 4,885,874 | A * | 12/1989 | Wedeniwski | 451/5 |
| 5,103,596 | A * | 4/1992 | Fujii et al. | 451/46 |
| 5,315,789 | A * | 5/1994 | Takashi | 451/5 |
| 5,392,566 | A * | 2/1995 | Wedeniwski | 451/5 |
| 5,525,092 | A * | 6/1996 | Hirano et al. | 451/5 |
| 6,409,573 | B1 * | 6/2002 | Mukai et al. | 451/5 |
| 6,666,118 | B2 | 12/2003 | Schroeder | |
| 7,083,500 | B2 * | 8/2006 | Junker | 451/10 |
| 7,809,463 | B2 * | 10/2010 | Yonezu et al. | 700/190 |
| 7,901,268 | B2 * | 3/2011 | Itoh et al. | 451/11 |
| 7,985,120 | B2 * | 7/2011 | Osaki et al. | 451/5 |
| 2005/0239376 | A1 * | 10/2005 | Junker | 451/11 |
| 2005/0255793 | A1 * | 11/2005 | Junker | 451/11 |
| 2005/0260926 | A1 * | 11/2005 | Junker | 451/11 |
| 2006/0166604 | A1 * | 7/2006 | Murai | 451/5 |
| 2007/0054598 | A1 * | 3/2007 | Uchida et al. | 451/5 |
| 2008/0050192 | A1 * | 2/2008 | Suzuki | 409/84 |
| 2008/0132146 | A1 * | 6/2008 | Yonezu et al. | 451/5 |
| 2008/0207090 | A1 * | 8/2008 | Itoh et al. | 451/11 |
| 2009/0017734 | A1 * | 1/2009 | Osaki et al. | 451/242 |

FOREIGN PATENT DOCUMENTS

| | | | |
|---|---|---|---|
| JP | 48-27383 | | 4/1973 |
| JP | 49-2229 | | 1/1974 |
| JP | 55-18318 | A | 2/1980 |
| JP | 5-84602 | A | 4/1993 |
| JP | 8-137527 | A | 5/1996 |
| JP | 2004-358607 | A | 12/2004 |
| JP | 2005-14171 | A | 1/2005 |

* cited by examiner

*Primary Examiner* — George Nguyen
(74) *Attorney, Agent, or Firm* — Foley & Lardner LLP

(57) ABSTRACT

A piston processing apparatus includes a work attaching head capable of fixing a piston material, a work rotating device, a grinding wheel, a grinding wheel rotating device, first and second moving mechanisms for moving the grinding wheel, a rotational angle detector for detecting a rotational angle of the work attaching head, a first and second position detectors for detecting a position of a grinding surface of the grinding wheel, a controller controls the first and second moving mechanisms to grind the outer circumferential surface by the grinding wheel based on target-position information of the grinding surface corresponding to a position on the outer circumferential surface of the piston material. According to the piston processing apparatus, the outer circumferential surface of the piston material can be processed into a three-dimensional shape with high-accuracy, and a piston that can improve fuel efficiency.

5 Claims, 3 Drawing Sheets

APPARATUS AND METHOD FOR PROCESSING PISTON

CROSS-REFERENCE TO RELATED APPLICATION

This application is based upon Japanese Patent Application No. 2008-137805, filed on May 27, 2008 (published as Japanese Patent Application Laid-Open No. 2009-285742 on Dec. 10, 2009); the entire contents of which are incorporated herein by reference for all purposes.

BACKGROUND

1. Field

The present invention relates to an apparatus and a method for processing an outer circumferential surface of a piston.

2. Description of Related Art

It is desired that a shape of an outer circumferential surface of a piston reciprocating in an internal combustion engine is formed so as to bring a constant gap to an inner surface of a cylinder at all positions in view of thermal expansion at combustion and so on. Therefore, it is needed to process a shape of an outer circumferential surface of a piston material three-dimensionally (to process it into a shape having a three-dimensional surface change to an ellipsoidal reference circumferential surface or a circular reference circumferential surface). Conventionally, such a process was done by use of a turning machine (U.S. Pat. No. 6,666,118) or a cutting machine (Japanese Patent Application Laid-Open No. H5-84602).

SUMMARY

However, by a turning process, since an outer circumferential surface of a piston material is ground by a turning tool, a high-accuracy three-dimensional process cannot be done. In addition, surface roughness of the outer circumferential surface after the process is coarse.

In addition, by a cutting process, since an outer circumferential surface of a piston material is ground by a cutting tool, a high-accuracy three-dimensional process cannot be done. In addition, surface roughness of the outer circumferential surface after the process is coarse.

An object of the present invention is to provide an apparatus for processing an outer circumferential surface of a piston material three-dimensionally with high-accuracy to manufacture a piston that can improve fuel efficiency, and a method for the same.

A first aspect of the present invention provides an apparatus for processing a piston, the apparatus including a work attaching head that is disposed on a work bench and on which a piston material can be fixed; a work rotating device that rotates the work attaching head; a grinding wheel that is disposed on a grinding wheel bench; a grinding wheel rotating device that rotates the grinding wheel; a first moving mechanism that moves at least one of the work attaching head and the grinding wheel in a approaching/distanced direction thereof to change a distance between the piston material and a grinding surface of the grinding wheel; a second moving mechanism that moves at least one of the work attaching head and the grinding wheel in a rotational axis direction of the piston material that is perpendicular to the approaching/distanced direction to change a contact position between an outer circumferential surface of the piston material and the grinding surface; a rotational angle detector that detects a rotational angle of the work attaching head; a first position detector that detects a position of the grinding surface in the approaching/distanced direction; a second position detector that detects a position of the grinding surface in the rotational axis direction; and a controller that has target-position information of the grinding surface corresponding to a position on the outer circumferential surface of the piston material and controls the first and second moving mechanisms to grind the outer circumferential surface by the grinding wheel based on the target-position information.

A second aspect of the present invention provides a method for processing a piston, the method using the apparatus for processing a piston according to the above first aspect, wherein the controller is operable to obtain each of detection results by the rotational angle detector, the first position detector, and the second position detector; and to control the work rotating device, the grinding wheel rotating device, the first moving mechanism, and the second moving mechanism to grind the outer circumferential surface by the grinding wheel based on the detection results and the target-position information.

According to the above first and second aspects, positional information of the outer circumferential surface of the piston material to the grinding surface 25*a* can be obtained from the detection result by the second position detector and the rotational angle detector. By controlling the first moving mechanism based on this positional information and the target-position information, the outer circumferential surface of the piston material can be processed into a three-dimensional shape (a shape having a three-dimensional surface change to an ellipsoidal reference circumferential surface or a circular reference circumferential surface). The outer circumferential surface can be grind-processed with high-accuracy by the grinding wheel and its surface roughness after the process can be made smooth. In addition, since the outer circumferential surface of the piston material can be processed into a three-dimensional shape with high-accuracy, a piston that can improve fuel efficiency can be manufactured.

In the above first aspect, it is preferable that the apparatus for processing a piston further includes a grinding wheel swinging device that swings the grinding wheel to change a contact area between the grinding surface of the grinding wheel and the outer circumferential surface of the piston material; and a swing position detector that detects a swing position by the grinding wheel swinging device.

Similarly, in the above second aspect, it is preferable that the apparatus for processing a piston further includes: a grinding wheel swinging device that swings the grinding wheel to change a contact area between the grinding surface of the grinding wheel and the outer circumferential surface of the piston material; and a swing position detector that detects a swing position by the grinding wheel swinging device, and the controller controls the grinding wheel swinging device based on a detection result by the swing position detector.

According to this, a grinding process can be done with selective use of areas on the grinding surface of the grinding wheel, so that the outer circumferential surface of the piston material can be processed with higher-accuracy.

In the above method for processing a piston, it is further preferable that the grinding surface of the grinding wheel includes a roughly-grinding area and a finishing area, and the controller is operable to grind the outer circumferential surface of the piston material by controlling the grinding wheel swinging device based on the detection result by the swing position detector to change the contact area between the grinding surface and the outer circumferential surface in order to perform a finishing process with the finishing area after a roughly-grinding process with the roughly-grinding area.

According to this, the grinding surface of the grinding wheel is segmented into the roughly-grinding areas and the finishing area, so that the finishing process can be done with the area that is not damaged in roughly-grinding by doing a finishing process with the finishing area after having done a roughly-grinding process with the roughly-grinding area. As a result, the outer circumferential surface of the piston material can be processed with higher-accuracy and its surface roughness can be made smooth.

DETAILED DESCRIPTION OF EMBODIMENTS

An embodiment of an apparatus for processing a piston according to an embodiment will be explained with reference to the drawings, hereinafter.

Figure 1:
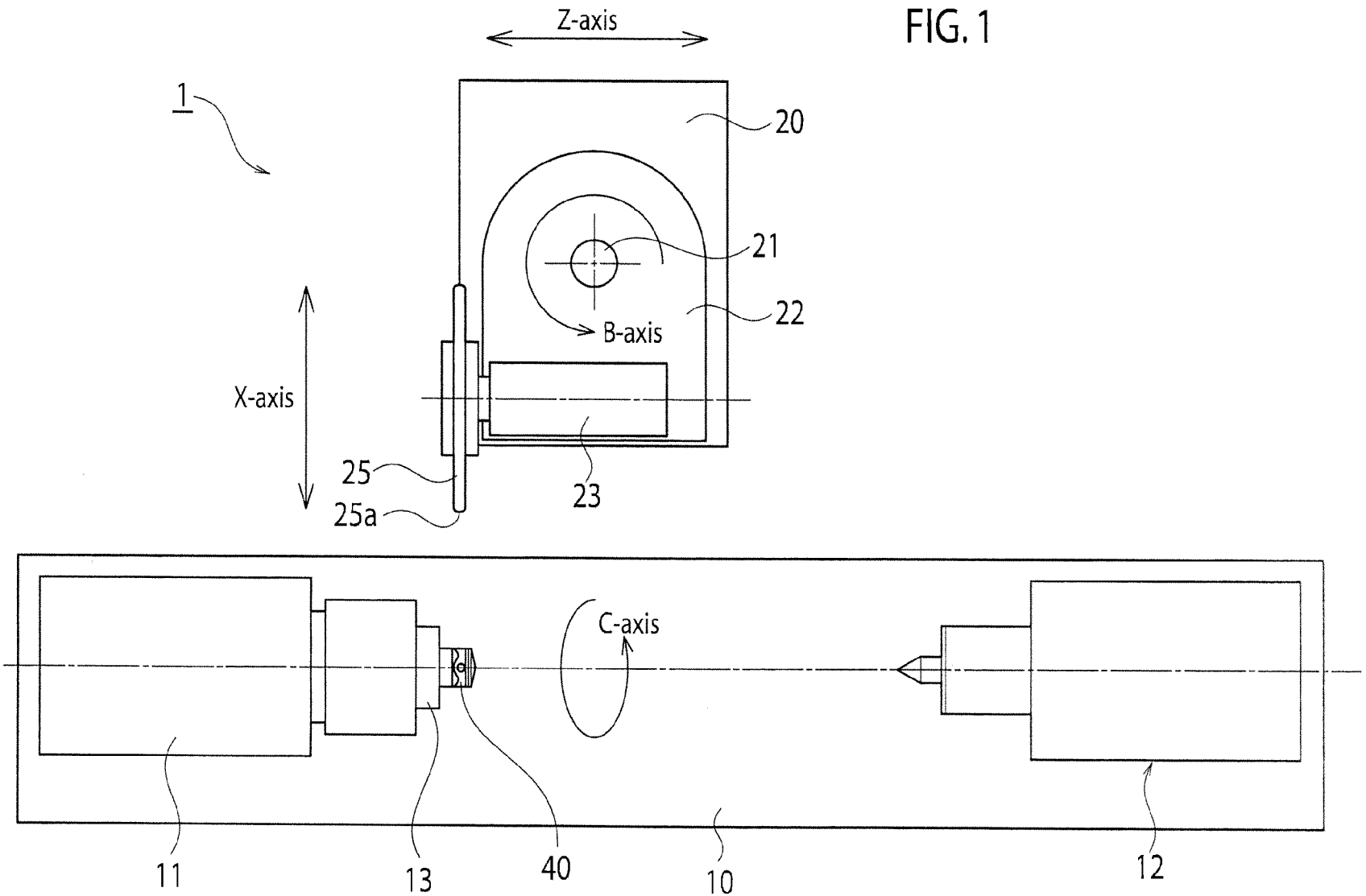
FIG. 1 is a schematic plan view of an apparatus for processing a piston according to an embodiment.
Figure 2:
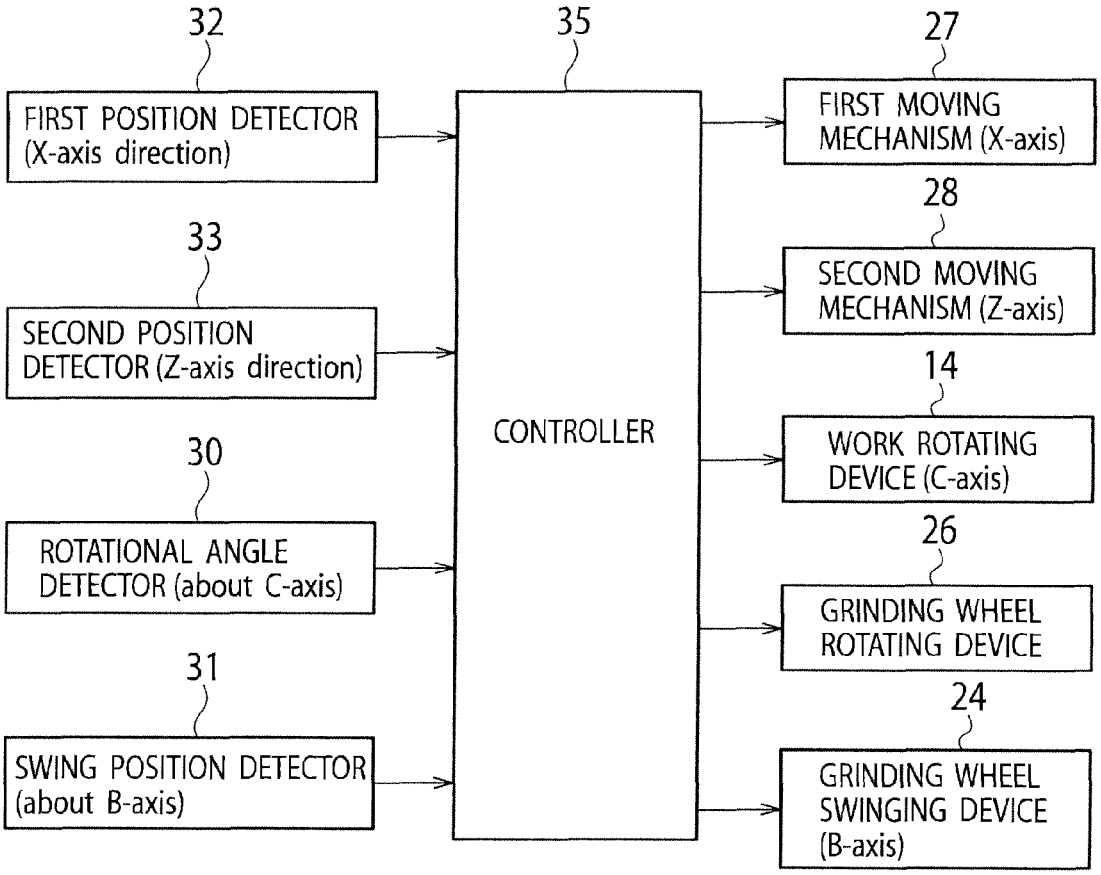
FIG. 2 is a circuit block diagram of the processing apparatus.

As shown in FIG. 1 and FIG. 2, the piston processing apparatus 1 includes a work bench 10 and a grinding wheel bench 20. A head support base 11 and a position measuring instrument 12 are disposed on the work bench 10. A work attaching head 13 is rotatably supported on the head support base 11. A piston material 40 that is a work to be processed can be attached onto the work attaching head 13. The piston material 40 is made of aluminum alloy, and fixed to the work attaching head 13 in a state where a center axis of its outer circumferential surface is made coincident with a rotational center of the work attaching head 13. The work attaching head 13 is rotated about a C-axis by a work rotating device 14. The piston material 40 is rotated due to a rotation of the work attaching head 13, so that a rotational angle of the piston material 40 (=rotational angle of the work attaching head) is changed. The rotational angle of the piston material 40 (=rotational angle of the work attaching head) is detected by a rotational angle detector 30.

A swing base 22 is supported on the grinding wheel base 20 swingably about a swing axis 21 as a swing pivot point. A grinding wheel attaching head 23 is fixed onto the swing base 22. The swing base 22 and the grinding wheel attaching head 23 are swung about a C-axis by a grinding wheel swinging device 24. A swing position of a grinding wheel 25 (swing position of the grinding wheel attaching head 23) is detected by a swing position detector 31.

Figure 3A:
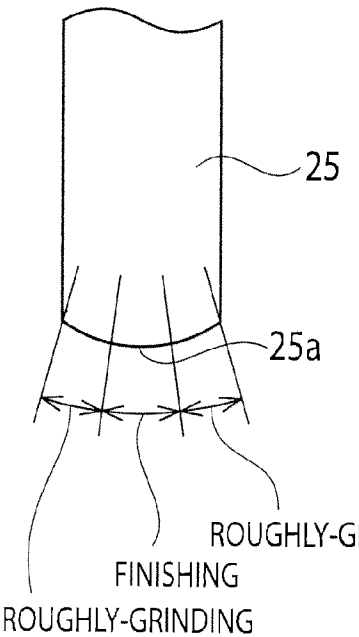
FIG. 3A is an enlarged side view showing a featured portion of a grinding wheel in the processing apparatus.

In addition, a grinding wheel 25 is rotatably supported on the grinding wheel attaching head 23. The grinding wheel 25 has a circular-plate shape, and its outer circumferential surface is a grinding surface 25*a*. The grinding wheel 25 is rotated about its rotational center as a pivot point by a grinding wheel rotating device 26. As shown in FIG. 3A, the grinding surface 25*a* is formed as a curved surface. Therefore, different areas on the grinding surface 25*a* can be contacted with an outer circumferential surface 40*a* of the piston material 40 by swinging the grinding wheel 25. Here, a center area on the grinding surface 25*a* is used as a finishing area, and edge areas on the grinding surface 25*a* are used as roughly-grinding areas.

In addition, the grinding wheel bench 20 is moved in a direction approaching-toward/distanced-from the work attaching head 13 (an X-axis direction) by a first moving mechanism 27. Therefore, a position of the grinding surface 25*a* of the grinding wheel 25 against the piston material 40 can be moved. When the grinding surface 25*a* is shifted along the X-axis direction by the first moving mechanism 27, its position in the X-axis direction is detected by a first position detector 32. Note that the position of the grinding surface 25*a* in the X-axis direction is detected by the first position detector 32 based on a reference such as a rotational center of the piston material 40 (=center of the work attaching head 13). Therefore, the position of the grinding surface 25*a* can be detected by detecting a distance along the X-axis direction between the rotational center of the piston material 40 (=center of the work attaching head 13) and the grinding surface 25*a*.

Further, the grinding wheel bench 20 is moved in a direction perpendicular to a moving direction of the first moving mechanism 27 (a Z-axis direction) by a second moving mechanism 28. Therefore, a position of the grinding surface 25*a* of the grinding wheel 25 can be moved along a rotational axis direction of the piston material 40 (the Z-axis direction). When the grinding surface 25*a* is shifted along the Z-axis direction by the second moving mechanism 28, its position in the Z-axis direction is detected by a second position detector 33.

Figure 3B:
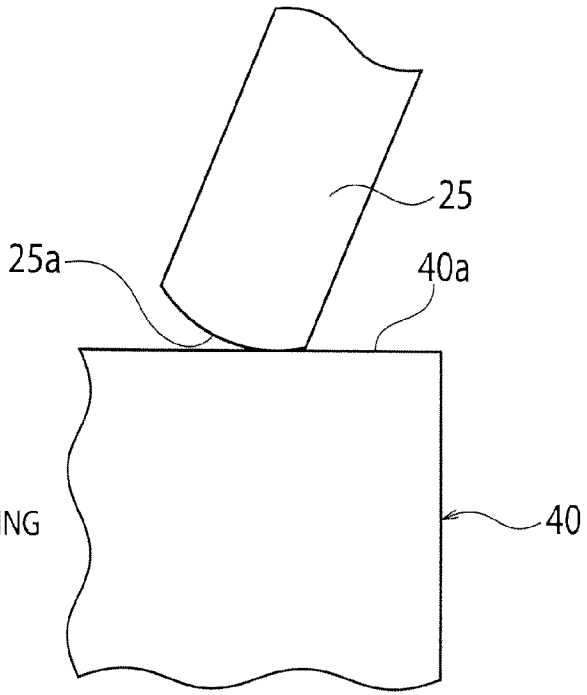
FIG. 3B is a side view showing a contact position between the grinding wheel and an outer circumferential surface of a piston material at a roughly-grinding process.
Figure 3C:
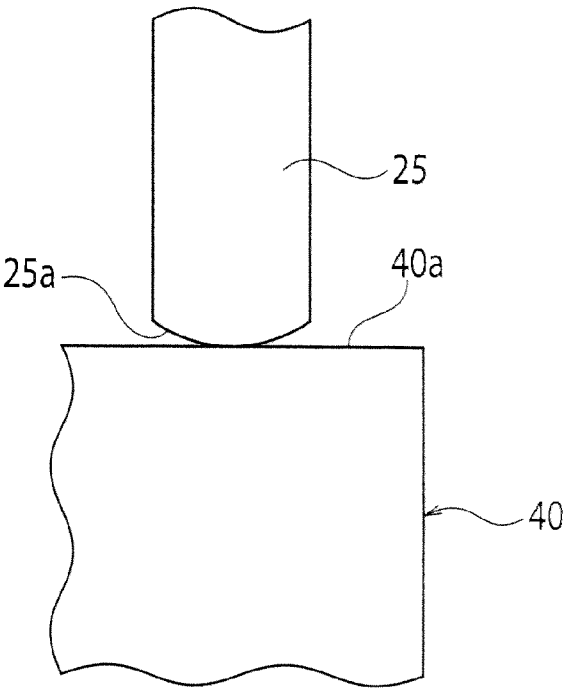
FIG. 3C is a side view showing a contact position between the grinding wheel and the outer circumferential surface of the piston material at a finishing process.

Next, a circuit system of the piston processing apparatus I will be explained. Each of the information detected by the first position detector 32, the second position detector 33, the rotational angle detector 30 and the swing position detector 31 is input to a controller 35. The controller 35 includes an internal memory. The internal memory stores positional information (position along the Z-axis and position about the C-axis) with respect to all areas on the outer circumferential surface 40*a* of the piston material 40, and target-position information (position along the X-axis) corresponding to this positional information. The target-position information is information on a target distance from the rotational axis center of the piston material 40 to the grinding surface 25*a* on grinding. Namely, the internal memory stores three-dimensional processing information for the outer circumferential surface 40*a* of the piston material 40. The controller 35 controls the first moving mechanism 27, the second moving mechanism 28, the work rotating device 14, the grinding wheel rotating device 26 and the grinding wheel swinging device in order to grind all the areas on the outer circumferential surface 40*a* using the grinding wheel 25 based on the target-position information Next, one example of a processing operation by the piston processing apparatus 1 will be explained. Firstly, the piston material 40 made by casting is attached to the work attaching head 13. Subsequently, the piston material 40 is rotated by the work rotating device 14, and the grinding wheel 25 is rotated by the grinding wheel rotating device 26. As shown in FIG. 3B, a swing angle of the grinding wheel 25 is adjusted by the grinding wheel swinging device 24 so as to contact the roughly-grinding area on the grinding surface 25*a* of the grinding wheel 25 with the outer circumferential surface 40*a*.

Subsequently, the grinding wheel 25 is moved by the second moving mechanism 28 so as to contact its grinding surface 25*a* sequentially with all the areas on the outer circumferential surface 40*a* of the piston material 40. The controller 35, along with a movement of the grinding wheel 25 by the second moving mechanism 28, recognizes positional coordinates (Z-axis, C-axis) from detection results by the first position detector 33 and the rotational angle detector 30, and moves the first moving mechanism 27 based on the target-position information (X-axis) corresponding to these positional coordinates. In this manner, the outer circumferential surface 40*a* of the piston material 40 is ground by the grinding wheel 25. This control is done for all the areas on the outer circumferential surface 40*a* of the piston material 40, so that all the areas on the outer circumferential surface 40*a* of the piston material 40 are roughly ground into a three-dimensional shape.

Subsequently, as shown in FIG. 3B, the swing angle of the grinding wheel 25 is adjusted by the grinding wheel swinging device 24 so as to contact the finishing area on the grinding surface 25*a* of the grinding wheel 25 with the outer circumferential surface 40*a*. Then, by an operation similar to the above roughly-grinding process, all the areas on the outer circumferential surface 40*a* of the piston material 40 are finished into a three-dimensional shape.

When the process by the piston processing apparatus 1 is completed, a surface treatment such as a diamond-like carbon (DLC) coating is processed to the surface of the piston material 40. Note that there may be a case where a surface treatment such as a diamond-like carbon (DLC) coating is not be processed.

In the above embodiment, the positional information of the outer circumferential surface 40*a* of the piston material 40 lacing to the grinding surface 25*a* can he obtained from the detection result by the second position detector 33 and the rotational angle detector 30. By controlling the first moving mechanism 27 based on this positional information and the target-position information, the outer circumferential surface 40*a* can be processed into a three-dimensional shape (a shape having a three-dimensional surface change to an ellipsoidal reference circumferential surface or a circular reference circumferential surface). The outer circumferential surface 40*a* can be grind-processed with high-accuracy by the grinding wheel 25 and its surface roughness after the process can be made smooth. In addition, since the outer circumferential surface 40*a* of the piston material 40 can be processed into a three-dimensional shape with high-accuracy, a piston that can improve fuel efficiency can be manufactured.

In the above embodiment, provided are the grinding wheel swinging device 24 that swings the grinding wheel 25 to change a contact area between the outer circumferential surface 40*a* of the piston material 40 and the grinding surface 25*a* of the grinding wheel 25, and the swing position detector 31 that detects the swing position by the grinding wheel swinging device 24. Therefore, a grinding process can be done with selective use of areas on the grinding surface of the grinding wheel, so that the outer circumferential surface of the piston material can be processed with higher-accuracy. Further, the grinding surface 25*a* of the grinding wheel 25 is segmented into the roughly-grinding areas and the finishing area, so that the finishing process can be done with the area that is not damaged in roughly-grinding by doing a finishing process with the finishing area after having done a roughly-grinding process with the roughly-grinding area. As a result, the outer circumferential surface 40*a* of the piston material 40 can be processed with higher-accuracy and its surface roughness can be made smooth.

Note that, although the first moving mechanism 27 moves the grinding wheel bench 20 i.e. the grinding wheel 25 in the above embodiment, it may move the work attaching head 13 or may move both the work attaching head 13 and the grinding wheel in their approaching/distanced direction (the X-axis direction).

In addition, although the second moving mechanism 28 moves the grinding wheel bench 20 i.e. the grinding wheel 25 in the above embodiment, it may move the work attaching head 13 or may move both the work attaching head 13 and the grinding wheel 25 in the rotational axis direction of the piston material 40 (the Z-axis direction).

What is claimed is:

1. An apparatus for processing a piston, he apparatus comprising:

a work attaching head that is disposed on a work bench and on which a piston material can be fixed;

a work rotating device that rotates the work attaching head;

a grinding wheel that is disposed on a grinding wheel bench;

a grinding wheel rotating device that rotates the grinding wheel;

a first moving mechanism that moves at least one of the work attaching head and the grinding wheel in a approaching/distanced direction thereof to change a distance between the piston material and a grinding surface of the grinding wheel;

a second moving mechanism that moves at least one of the work attaching head and the grinding wheel in a rotational axis direction of the piston material that is perpendicular to the approaching/distanced direction to change a contact position between an outer circumferential surface of the piston material and the grinding surface;

a rotational angle detector that detects a rotational angle of the work attaching head;

a first position detector that detects a position of the grinding surface in the approaching/distanced direction;

a second position detector that detects a position of the grinding surface in the rotational axis direction; and a controller that has target-position information of the grinding surface corresponding to a position on the outer circumferential surface of the piston material and controls the first and second moving mechanisms to grind the outer circumferential surface by the grinding wheel based on the target-position information.

2. The apparatus for processing a piston according to claim 1, the apparatus further comprising:

a grinding wheel swinging device that swings the grinding wheel to change a contact area between the grinding surface of the grinding wheel and the outer circumferential surface of the piston material; and a swing position detector that detects a swing position by the grinding wheel swinging device.

3. A method for processing a piston, the method using the apparatus for processing a piston according to claim 1, wherein the controller is operable to obtain each of detection results by the rotational angle detector, the first position detector, and the second position detector; and to control the work rotating device, the grinding wheel rotating device, the first moving mechanism, and the second moving mechanism to grind the outer circumferential surface by the grinding wheel based on the detection results and the target-position information.

4. The method for processing a piston according to claim 3, wherein the apparatus for processing a piston further includes:

a grinding wheel swinging device that swings the grinding wheel to change a contact area between the grinding surface and the outer circumferential surface; and a swing position detector that detects a swing position by the grinding wheel swinging device, and the controller controls the grinding wheel swinging device based on a detection result by the swing position detector.

5. The method for processing a piston according to claim 4, wherein the grinding surface of he grinding wheel includes a roughly-grinding area and a finishing area, and the controller is operable to grind the outer circumferential surface of the piston material by controlling the grinding wheel swinging device based on the detection result by the swing position detector to change the contact area between the grinding surface and the outer circumferential surface in order to perform a finishing process with the finishing area after a roughly-grinding process with the roughly-grinding area.

* * * * *